United States Patent [19]

Uetsuhara

[11] Patent Number: 4,706,055

[45] Date of Patent: Nov. 10, 1987

[54] ELECTROMAGNETIC ACTUATOR HAVING RELUCTANCE ADJUSTING MEANS

[75] Inventor: Tokio Uetsuhara, Urawa, Japan

[73] Assignee: Mitsubishi Mining & Cement Co., Ltd., Tokyo, Japan

[21] Appl. No.: 824,019

[22] PCT Filed: Jun. 4, 1985

[86] PCT No.: PCT/JP85/00314

§ 371 Date: Jan. 21, 1986

§ 102(e) Date: Jan. 21, 1986

[87] PCT Pub. No.: WO86/00168

PCT Pub. Date: Jan. 3, 1986

[30] Foreign Application Priority Data

Jun. 8, 1984 [JP] Japan ..... 59-116499

[51] Int. Cl.[4] ..... H01F 7/08

[52] U.S. Cl. ..... 335/229; 335/230; 335/279

[58] Field of Search ..... 335/229, 230, 234, 78, 335/79, 80, 81, 84, 85, 261, 279

[56] References Cited

U.S. PATENT DOCUMENTS 3,783,423 1/1974 Mater et al. ..... 335/229 X 4,157,520 6/1979 Moates et al. ..... 335/229 X 4,509,026 4/1985 Matsushita ..... 335/78 X

FOREIGN PATENT DOCUMENTS 148411 3/1983 Japan ..... 335/230

*Primary Examiner*—George Harris

*Attorney, Agent, or Firm*—Bierman & Muserlian

[57] ABSTRACT

An electromagnetic actuator comprises a stationary element made of soft magnetic material which element has a plurality of magnetic poles, a magnet one magnetic pole of which is secured to the stationary element, a movable element made of soft magnetic material which element is faced with the magnetic poles of the stationary element and the other magnetic pole of the magnet through narrow gaps so as to form a magnetic circuit arranged in parallel to the direction of magnetic flux generated by the magnet, and a coil element wound around the stationary element which coil is so arranged as to energize the magnetic circuit in series. When electric current is flowed through the coil, the balance of magnetic force between these magnetic fluxes loses and therefore, the movable element is reciprocally moved with respect to the stationary element. This device can be actuated with a large moving force generated by a fine current.

1 Claim, 9 Drawing Figures

ELECTROMAGNETIC ACTUATOR HAVING RELUCTANCE ADJUSTING MEANS

TECHNICAL FIELD

The present invention relates generally to an electromagnetic actuator which is used for an electrically controlled device. More particularly, the present invention relates to an electromagnetic actuator which electromagnetically controls a particular device between one mechanical stable state and another; for example of electromagnetic locking device, electromagnetic valve control device, electromagnetic relay, or the like.

BACKGROUND TECHNIQUE

Conventionally, a monostable electromagnetic actuator as shown in FIG. 6 and a bistable electromagnetic actuator as shown in FIG. 7 have been commonly used. The monostable type shown in FIG. 6 comprises stationary element 1 made of soft magnetic material, permanent magnet 3 the magnetic pole S of which is secured to the stationary element 1, movable element 2 made of soft magnetic material, and electromagnetic coil 4 arranged in the stationary element 1. One end of the movable element 2 is connected to a spring 5 so as to apply bias force to the movable element 2. FIG. 6 shows one mechanical stable state that a magnetic pole 1*a* of the stationary element 1 and another magnetic pole 2*a* of the movable element 2 are magnetically attracted to each other against the bias force of the spring 5 due to magnetic flux 14 caused by the permanent magnet 3. When electric current in a pulse series is so flowed through the electromagnetic coil 4 as to generate magnetic flux 15 in the counter direction of the magnetic flux 14 caused by the permanent magnet 3, the magnetic attractive force between the stationary element 1 and the movable element 2 is cancelled and thus the movable element 2 is moved by the bias force of the spring 5.

FIG. 7 shows also one mechanical stable state of the other actuator wherein a movable element 2 made of soft magnetic material is magnetically attracted to one end of a stationary element 1 made of soft magnetic material. That is, a permanent magnet 3 is arranged in the stationary element 1 so that magnetic pole S of the magnet 3 is secured to the inner surface of the element 1. The magnet 3 generates magnetic flux 14 which makes first magnetic pole 2*a* of the movable element 2 to contact the first magnetic pole 1*a* of the stationary element 1. When electric current in a pulse series is flowed through a first coil 4*a* windingly disposed in the stationary element 1 so as to generate magnetic flux 15 in the counter direction of the magnetic flux 14 caused by the permanent magnet 3, the movable element 2 is moved rightward in the drawing and thus second magnetic pole 2*b* of the movable element 2 is magnetically contacted to second magnetic pole 1*b* of the stationary element 1; this is another mechanical stable state.

In order to return this actuator to the initial stable condition, electric current in a pulse series is flowed through second coil 4*b* in the reverse direction of the above.

However, as can be clear from the aforementioned explanation, these conventional electromagnetic actuators have the following demerits.

(1) The electromagnetic actuator requires long value of ampere turn required for the coil in order to switch the mechanical stable state to another because the permanent magnet being arranged in the magnetic circuit which gererates magnetomotive force caused by the flow of the current through the coil and having large magnetic reluctance is required.

(2) The monostable electromagnetic actuator requires mechanical bias force caused by a spring or the like, so that its constitution becomes complicated.

(3) The electromagnetic actuator requires a particular permanent magnet having so strong magnetomotive force as to maintain the mechanical stable condition.

(4) The bistable electromagnetic actuator does not always require means for generating mechanical bias force such as a spring, but it requires two coils capable of generating so large magnetomotive force as to move the movable element. This causes a large sized and complicated device.

DISCLOSURE OF THE INVENTION

With these problems in mind, it is the primary object of the present invention to provide an improved electromagnetic actuator which has a compact size, light weight, and simple structure with same electric power property.

Referring to FIG. 1, there is shown a schematic illustration of the electromagnetic actuators according to the present invention. A movable element 2 made of magnetic material is reciprocally moved in the direction represented by the arrow 2*a* with respect to a stationary element 1 made of magnetic material. Assuming that magnetic flux $\phi$ caused by a permanent magnet 3 is dividingly flowed into magnetic flux $\phi_a$ and $\phi_b$ and neglecting the leakage of the magnetic flux, the magnetic flux $\phi$ can be represented by the following equation.

$$\phi=\phi_a+\phi_b \tag{1}$$

When electric current is flowed through a coil 4 so as to generate magnetic flux $\phi_i$, each magnetic flux is overlapped with the magnetic flux $\phi_i$ through magnetic path shown in the drawing since inner reluctance of the permanent magnet 3 is large. Thus the movable element 2 is applied with force Fe represented by the following equation.

$$\begin{aligned} Fe &= K\{-(\phi_i+\phi_a)^2+(\phi_i-\phi_b)^2\} \\ &= K\{-\phi_a^2+\phi_b^2-2\phi_i\times(\phi_a+\phi_b)\} \end{aligned} \tag{2}$$

wherein; K represents a proportional constant.

FIG. 2 shows a conventional plunger type electromagnetic actuator which applies a force $F_p$ represented by the following equation to a movable element 2.

$$F_p=K\phi_i^2 \tag{3}$$

In this equation, bias force caused by a spring 5 is neglected.

According to these equations (1), (2) and (3), the ratio of forces Fe/Fp generated when particular current at the same ampere turn is supplied to the self-supporting type (latching type) electromagnetic actuator shown in FIG. 1 and the plunger type shown in FIG. 2 can be represented by the following equation.

$$Fe/Fp=-\phi^2+2\phi(\phi_b-\phi_i)/\phi i^2 \tag{4}$$

A maintaining force Fl is represented by the following equation.

$$Fl=\phi_b^2-\phi_a^2 \quad (5)$$

However, when the value of $\phi_i=0$, in other words, the coil 4 is free from electric current, the latching type electromagnetic actuator will maintain the latching state; that is, the movable element 2 is attracted to a magnetic pole, by applying the force Fl represented by the equation (5) to the movable element 2.

If the equation (4) is rearranged by substituting $$\phi_i=1,\ \phi=\alpha\phi_i=\alpha,\ \phi_b=\beta\phi=\alpha\cdot\beta,$$

the following equation will be provided.

$$Fe/Fp=-\alpha^2+2\alpha(\alpha\cdot\beta-1) \quad (6)$$

This equation (6) is represented by graphs shown in FIG. 3 wherein the variation of Fe/Fb is represented by parameters $\alpha$ and $\beta$. That is, if condition $\phi_b>0.5\phi$ is predetermined regardless of the positon of movable element, the movable element is attracted to the $\phi_a$ side pole and stablely held at the position when electric current is being flowed through the coil 4. While the movable element 2 is attracted to the $\phi_b$ side pole and stablely held at the positon when the coil 4 is free from electric current.

Additionally, according to the equation (6), FIG. 3 represents that the latching type electromagnetic actuator according to the present inventin can generate attractive force several times greater than the conventional one by energizing the coils at the same ampere turn, when the electromagnetic actuator according to the present invention is so arranged as to determine the value of $\beta$; i.e., the number of $\phi_b/\phi$, be close to 0.5 and at largest 1. The permanent magnet 3 having magnetomotive force being more than the ampere turn is arranged in the present invention. Thus, the present invention can provide the electromagnetic actuator improved in its save electric power property.

The present invention has been achieved depending on the above mentioned knowledge. The electromagnetic actuator of the invention is comprised of a stationary element made of soft, magnetic material, the stationary element having a pluraity of magnetic poles; a magnet, one magnetic pole of the magnet being secured to the stationary element;

a movable element made of soft magnetic material, the moveable element being faced with the magnetic poles of the stationary element and the other magnetic pole of the magnet through a narrow gap so as to form a magnetic circuit arranged in parallel to the direction of magnetic flux generated by the magnet; and a coil element wound around the stationary element, the coil being so arranged as to energize the magnetic circuit in series, whereby the balance of magnetic force between the magnetic fluxes losses and the moveable element is reciprocally moved with respect to the stationary element when electric current is flowed through the coil.

As given explanation above, the present invention can provide a monostable or bistable electromagnetic actuator which can be used for industry or domestic uses.

(1) The device according to the present invention does not consume electric energy for holding the mechanical stable state and provides great actuating force with less energizing thereby saving energy.

(2) The present invention does not require means for generating mechanical bias force such as a spring by using one coil, so that the present invention can provide a device having a simple structure, a compact size, a light weight, and a long life time.

(3) According to the present invention, it is easily to select holding force (magnetic attractive force) for holding a mechanical stable state and actuating force for moving the movable element from the state.

(4) The device according to the present invention requires only two wires system for operating the device.

(5) The device according to the present invention requires only short time to supply electric current, so that the generation of heat owing to electric current supplied to the coil be lowered.

And the device has a compact size and a light weight.

BEST MODE FOR EMBODYING THE PRESENT INVENTION

Figure 4A:
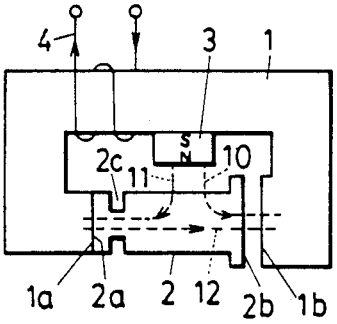
FIGS. 4(*a*) and (*b*) are schematic illustrations showing a first embodiment of elecromagnetic actuator according to the present invention.
Figure 4B:
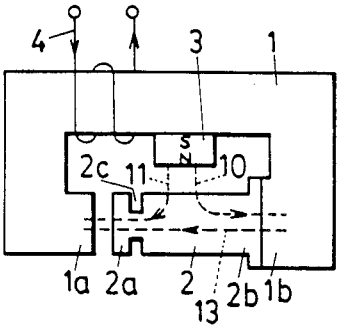

A first embodiment of the present invention is explained as follows. FIGS. 4(*a*) and (*b*) are illustrations for explaining the embodiment of an electromagnetic actuator according to the present invention. In the drawings, the reference numeral 1 denotes a stationary element made of a soft magnetic material. This stationary element 1 is further formed in a substantially C-shape which is provided with a permanent magnet 3. The magnetic pole S of the permanent magnet 3 is secured to the inner surface of the C-shape stationary element 1. A movable element 2 is so fit in the opening of the C-shape stationary element 1 through a fine gap as to form magnetic circuit and be subjected to the magnetic attractive force by the permanent magnet 3. Thus, under such condition as shown in FIG. 4(*a*), the magnetic flux caused by the permanent magnet 3 is divided into two flows; i.e., one magnetic flux 10 flows the right end 2*b* of the movable element 2, narrow gap, and the right end 1*b* of the stationary element 1, and another magnetic flux 11 flows the left end 2*a* of the movable element 2 and the left end 1*a* of the stationary element 1.

Under such condition as shown in FIG. 4(*a*), when the electric current in a pulse series is so flowed through a coil 4 wound around the stationary element 1 as to generate the magnetic flux 12, the divided magnetic flux 11 caused by the permanent magnet 3 is cancelled and the divided magnetic flux 10 is overlapped with the magnetic flux 12. The movable element 2 is moved right-wards and maintained in the second mechanical stable state as shown in FIG. 4(*b*) wherein the right end 2*b* of the movable element 2 contacts to the right end 1*b* of the stationary element 1.

Under this second condition, when the electric current is flowed in the reverse direction of the former so as to generate the magnetic flux 13, the movable element 2 is returned to the first stable state. Accordingly, the first embodied device functions as a bistable electromagnetic actuator.

In this embodiment, the movable element 2 is further formed with a magnetic saturating section 2*c* which is grooved. This magnetic saturating section 2*c* is intended to decrease the sectional area of magnetic path, so that the quantity of passed magnetic flux can be limited to a predetermined level by saturating phenomenon. That is, this magnetic saturating section 2*c* increases magnetic reluctace. On the other hand, the sectional area of the right ends 1*b* and 2*b* is larger than that of the left ends 1*a* and 2*a* so as to decrease magnetic reluctance of air gap.

Figure 1:
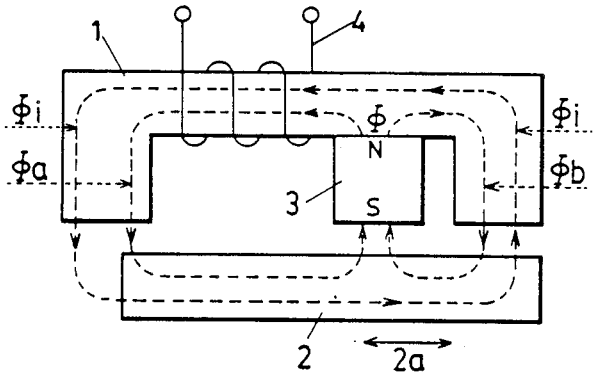
FIG. 1 is a schematic illustration showing a basic model of an electromagnetic actuator according to the present invention.
Figure 2:
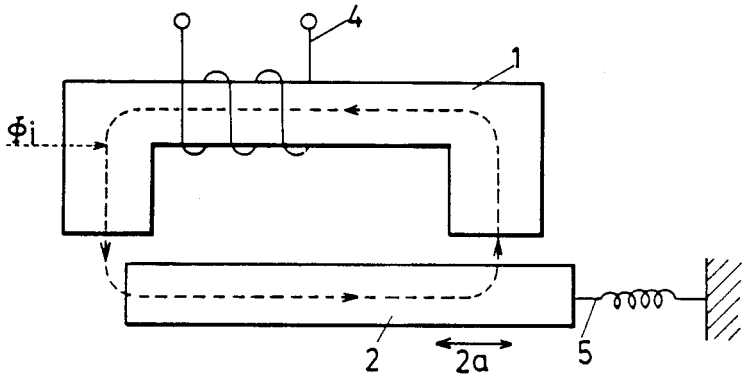
FIG. 2 PRIOR ART
FIG. 2 is a schematic illustration showing a basic model of a conventional electromagnetic actuator.
Figure 3:
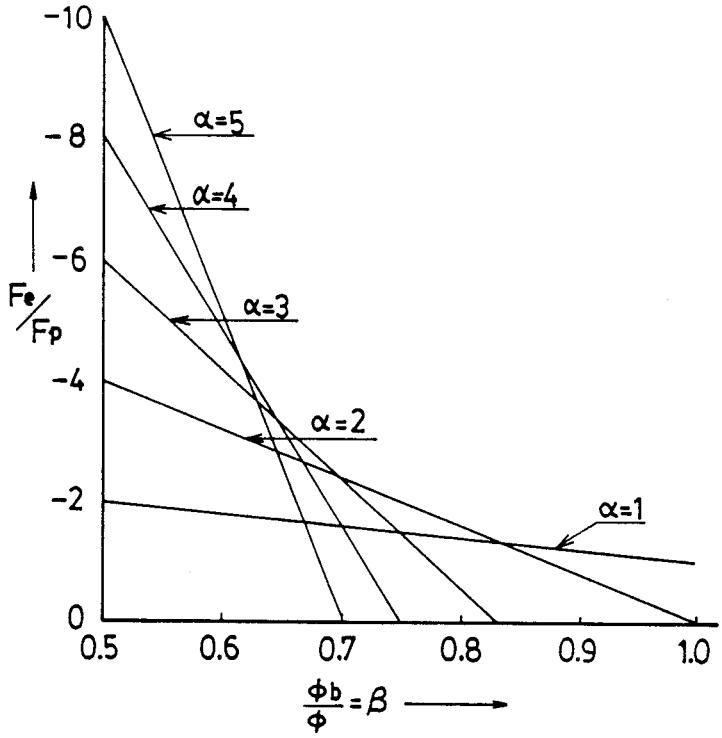
FIG. 3 is a graphical representation showing the relation between magnetic flux and actuating force according to the device shown in FIG. 1.

According to the above mentioned manner, the values of the magnetic flux 10/11 are adjusted and the electric current in a pulse series having a specific value to generate the magnetic flux 12 identical with the magnetic flux 11 is flowed through the coil 4 in the direction of arrow shown in FIG. 4(*a*), so that the movable element 2 can be moved to the position shown in FIG. 4(*b*). As is clear from FIG. 3, the force for moving the movable element 2 is remarkably varied in accordance with the adjustment between the values of magnetic flux 10/11.

Figure 5A:
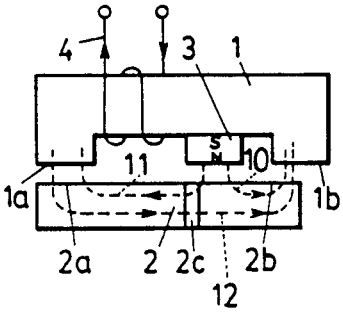
FIGS. 5(*a*) and (*b*) are schematic illustrations showing a second embodiment of electromagnetic actuator according to the present invention.
Figure 5B:
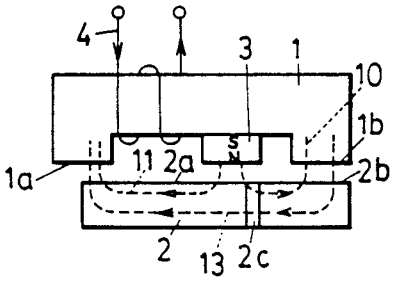
Figure 6:
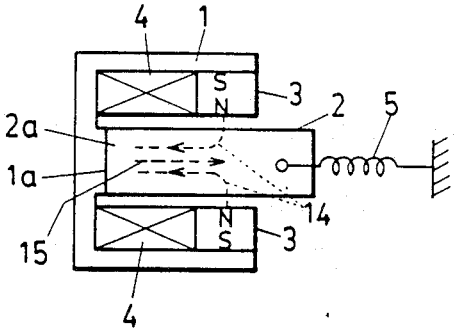
FIG. 6 PRIOR ART
FIGS. 6 and 7 are schematic illustrations showing conventional electromagnetic actuator.
Figure 7:
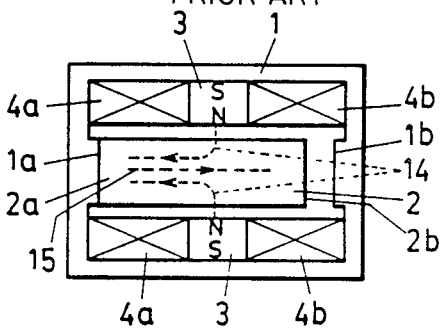
FIG. 7 PRIOR ART

FIGS. 5(*a*) and (*b*) are illustrations for explaining a second embodiment of the present invention. In the drawings, a stationary element 1 made of soft magnetic material is formed in a substantial C-shape. A permanent magnet 3 is secured to the stationary element 1 in such manner that the magnetic pole S of the magnet 3 is fixed to the stationary element 1. The magnetomotive force of the permanent magnet 3 is flowed through a movable element 2 made of soft magnetic material via air gap, and divided into a magnetic flux 11 flowing through the gap defined between a left end 1*a* of the stationary element 1 and a left end 2*a* of the movable element 2 and a magnetic flux 10 flowing through the gap defined between a right ends 1*b* and 2*b*. The movable element 2 is positioned in its mechanical stable state as shown in FIG. 5(*a*), wherein the area of opposite surfaces of the left ends 1*a* and 2*a* and thus the magnetic reluctance of the left ends 1*a* and 2*a* is relatively larger than that of the right ends 1*b* and 2*b* and thus the magnetic reluctance of the left ends is less than that of the right ends.

The movable element 2 may be modified by forming a magnetic saturating section 2*c* in order to improve magnetic property. For example, the movable element 2 is further provided with a rectangular hysteresis material for acting magnetic saturating effect against one of the magnetic flux flowes 10 and 11 which is higher than a predetermined value.

In the electromagnetic actuator constituted as the above description, the movable element 2 can be reversibly moved between the mechanical bistable states shown in FIGS. 5(*a*) and (*b*) with respect to the stationary element 1 in response to the flowing direction of the electric current applied to the coil 4. Further, the force to move the movable element can be generated by a small amount of electric power. For example, a conventional monostable electromagnetic actuator requires electric power of 20 W for generating the force of 1 kg to the stroke of 2 mm and conventional bistable actuator also requires electric power of 15 W for the same. On the other hand, the embodied device (both types) requires only 5 W for the same.

In the aforementioned embodiments shown in FIGS. 4 and 5, if the magnetic circuit is so designed as to always satisfy the condition $\phi_b > \phi_a$, the movable element 2 is attracted to the magnetic flux $\phi_a$ flowing side only when electric current is flowed through the coil 4, and is always held by the force $Fe = \phi_b^2 - \phi_a^2$ to the magnetic flux $\phi_b$ flowing side when the coil 4 is free from the electric current. This constitution provides the monostable electromagnetic actuator.

UTILIZATION FOR INDUSTRIAL ART

As explained above, the device according to the present invention can be utilized for various industry arts and domestic uses such as electromagnetic actuating valve, electromagnetic actuating piston, electromagnetic locking device, electromagnetic actuating mechanism for switch, essentially safe explosion-preventing device, retracting mechanism for emergency, or the like.

What is claimed is:

1. An electromagnetic actuator comprising, a stationary element made of soft, magnetic material, the stationary element having a plurality of magnetic poles;

a permanent magnet, one magnetic pole of the permanent magnet being secured to the stationary element;

a moveable element made of soft, magnetic material, the moveable element being faced with the magnetic poles of the stationary element and the other magnetic pole of the permanent magnet through narrow gap to form a magnetic circuit arranged in parallel to the direction of magnetic flux generated by the permanent magnet;

a means for adjusting magnetic reluctance to control the magnetic distribution in the magnetic circuit parallel to the direction of magnetic flux of the permanent magnet, which means magnetically saturates against the magnetomotive force caused by the permanent magnet; and a coil element wound around the stationary element, the coil being so arranged as to energize the magnetic circuit, whereby the moveable element is reciprocally moved with respect to the stationary element when electric current is flowed through the coil.

* * * * *